US006119352A

United States Patent [19]

Adamczak

[11] Patent Number: 6,119,352

[45] Date of Patent: Sep. 19, 2000

[54] MANUAL LEFT OR RIGHT HAND CAN OPENER

[76] Inventor: Gregory Mark Adamczak, 873 Washington Blvd., Stamford, Conn. 06901

[21] Appl. No.: 09/094,328

[22] Filed: Jun. 9, 1998

[51] Int. Cl.[7] ..... B67B 7/46

[52] U.S. Cl. ..... 30/418; 30/422

[58] Field of Search ..... 30/421, 422, 424, 30/426, 409, 431, 436, 425, 418, 417

[56] References Cited

U.S. PATENT DOCUMENTS

| | | | |
|---|---|---|---|
| 2,474,982 | 7/1949 | McLean . | |
| 2,563,569 | 8/1951 | Walton | 30/422 |
| 2,565,048 | 8/1951 | Ruch | 30/422 |
| 2,565,144 | 8/1951 | McLean . | |
| 2,592,933 | 4/1952 | McLean . | |
| 2,592,937 | 4/1952 | McLean | 30/422 |
| 2,675,611 | 4/1954 | Moore | 30/422 |
| 2,810,952 | 10/1957 | Sundell | 30/425 |
| 3,002,275 | 10/1961 | Edlund | 30/422 |
| 3,059,333 | 10/1962 | Landry | 30/409 |
| 3,075,285 | 1/1963 | Desjardins et al. | 30/421 |
| 3,321,830 | 5/1967 | McLean | 30/422 |
| 3,594,901 | 7/1971 | Van Der Kroft | 30/422 |
| 4,053,981 | 10/1977 | Aberer | 30/421 |
| 4,574,482 | 3/1986 | van der Wouden . | |
| 5,170,565 | 12/1992 | Brisard | 30/421 |
| 5,692,309 | 12/1997 | Pereira | 30/417 |

FOREIGN PATENT DOCUMENTS

| | | | |
|---|---|---|---|
| 84887 | 4/1920 | Switzerland | 30/417 |
| 2246756 | 2/1992 | United Kingdom | 30/426 |

*Primary Examiner*—M. Rachuba
*Assistant Examiner*—Omar Flores
*Attorney, Agent, or Firm*—Ohlandt, Greeley, Ruggiero & Perle, L.L.P.

[57] ABSTRACT

A manual can opener that can be operated with ease by both left-handed and right-handed users is provided. The initial rotation of an operating handle in either direction moves a transport wheel linearly toward a cutting blade to engage the end of the can, and simultaneously cants the cutting blade in a direction opposite that of handle rotation so that it is in proper condition to cut the end from the can. Further rotation of the operating handle, in the direction of the initial rotation, then forces the can against the blade to cut the end of the can.

20 Claims, 2 Drawing Sheets

MANUAL LEFT OR RIGHT HAND CAN OPENER

FIELD OF THE INVENTION

The present invention relates to a can opener. Specifically, the present invention relates to a manually operated can opener that can be operated equally as well by a left or right handed user. The can opener of the present invention allows one to select the direction in which the operating handle is turned. Such selection allows the user to operate readily the can opener with either hand.

BACKGROUND OF INVENTION

In general, manually operated can openers employ a rotary transport wheel and a cutting blade. Each component is arranged on separate elements of a hinged frame. In operation, the rim of a can is engaged by the transport wheel. The frame elements are brought together to move the cutting blade into contact with the top of the can with such pressure that the can top is pierced or pressured by the cutting blade. A handle, which is attached to the rotary transport wheel, is then turned by the user to rotate the can into the blade and, thus, cut the can top.

With such can openers, an operating handle is provided only on one side of the transport wheel. Accordingly, when the transport wheel positions the can for cutting, the blade is capable of cutting in only one direction. Since a majority of people are right handled, such manually operated can openers have been configured so that the handle is turned readily with one's right hand. Obviously, such can openers are difficult to use with a left hand. Can openers can be made to be operated by a left hand or a left-handed person. However, such left-handed operable can openers provide the same difficulty to a right-handed person that conventional can openers provide to a left-handed person.

Thus, there is a need for a manually operated can opener that can be operated easily by either the left or right hand of a person. Also, such a can opener should be easy to operate to remove the can top by a simple rotation of the operating handle.

SUMMARY OF THE INVENTION

It is an object of the present invention to provide a manually operated can opener that can be selectively operated with either the right or left hand of the user.

It is another object of the present invention to provide such a can opener in which the operating handle can be selected, as desired, to rotate in a clockwise or counterclockwise direction.

It is a further object of the invention to provide such a can opener in which rotation of the operating handle, in either direction, automatically moves the cutting blade into proper position to cut the can top.

These and other objects of the present invention are provided by a can opener having a transport wheel, a cutting blade and a driver operatively coupled to the transport wheel and cutting blade and arranged to bring the transport wheel and cutting blade into engagement with the can to cut an end from the can. A handle is rotatable in the clockwise and counterclockwise directions. A directional selector is operatively coupled to the driver in such a manner that the driver rotates in first and second directions corresponding to the clockwise and counterclockwise directions, respectively.

Initial rotation of the handle moves the transport wheel and the cutting blade into engagement with the can. Further rotation of the handle forces the can against the cutting blade to cut the end, such as a top, from the can.

DESCRIPTION OF PREFERRED EMBODIMENTS

Figure 1:
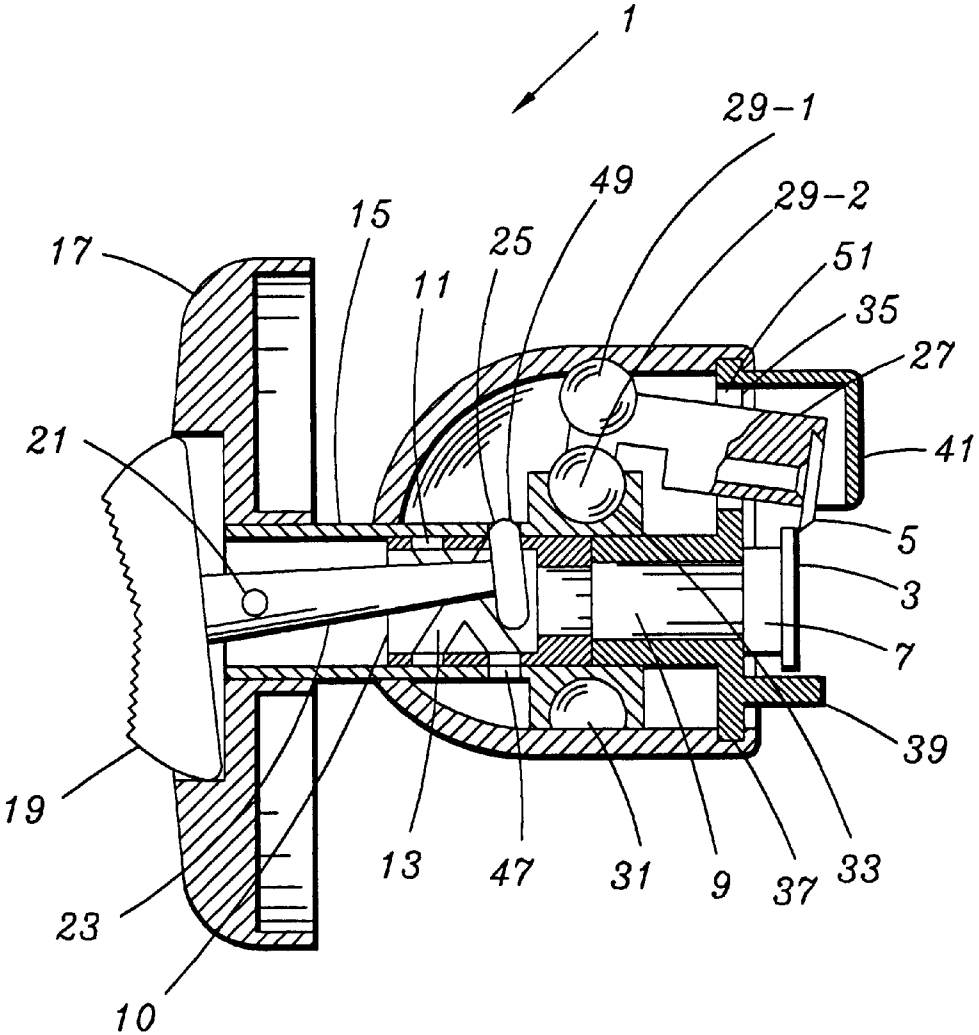
FIG. 1 is a sectional view of the can opener of the present invention.
Figure 4:
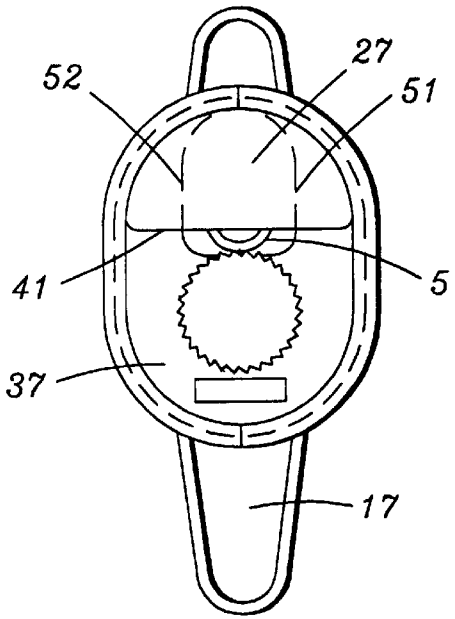
FIG. 4 is a front view of the can opener of FIG. 3, but with the can removed to better show the position of the cutting blade of the can opener.

Referring to the figures and, in particular, FIG. 1, there is provided a manually operated can opener generally represented by reference numeral 1. The can opener 1 has a housing 36, a drive shaft housing or driver 15 connected to the housing, and a handle 17 connected to the driver.

The driver 15 is in the form of a hollow shaft having a central axis 7. The shaft of driver 15 has one end operatively connected to handle 17. A cam 10 is preferably in the form of a hollow shaft, and is partially mounted concentrically within driver 15 and extends outwardly therefrom. The cam 10 is mounted for rotation with driver 15. The cam 10 has an inner circumference. The inner circumference has a first helical cam path (left hand mode) 11 and a second helical cam path (right hand mode) 13.

The cam 10 has mounted thereto a drive shaft 9. The drive shaft 9 is concentrically mounted within cam 10 and, thus, driver shaft 9 to rotate wit-h and slide linearly within the cam. In an alternative embodiment, drive shaft 9 and cam 10 can be one piece. In other embodiments, while perhaps difficult to assembly, drive shaft 9 and transport wheel 3 can be one piece, as well as drive shaft 9, cam 10 and transport wheel 3 can be one piece.

The drive shaft 9 has a first end with a transport wheel 3 connected thereto. Accordingly, the rotation of drive shaft 9 rotates transport wheel 3 about central axis 7 of driver 15.

Figure 2:
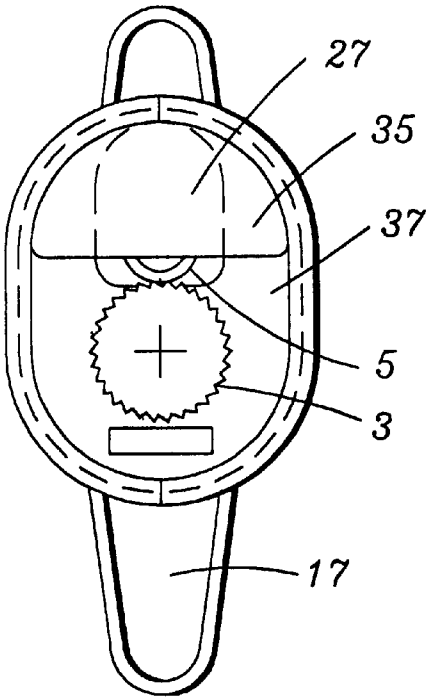
FIG. 2 is a front view of the can opener of FIG. 1.

As shown in FIG. 2, housing 36 has connected thereto or integral formed therewith a mounting plate 37. The mounting plate 37 is arranged to enclose driver 15 and cam 10. There is positioned adjacent mounting plate 37 and outside housing 36, both a cutting blade 5 and transport wheel 3. The mounting plate 37 has a can guide 39 that extends outward from the mounting plate.

Figure 3:
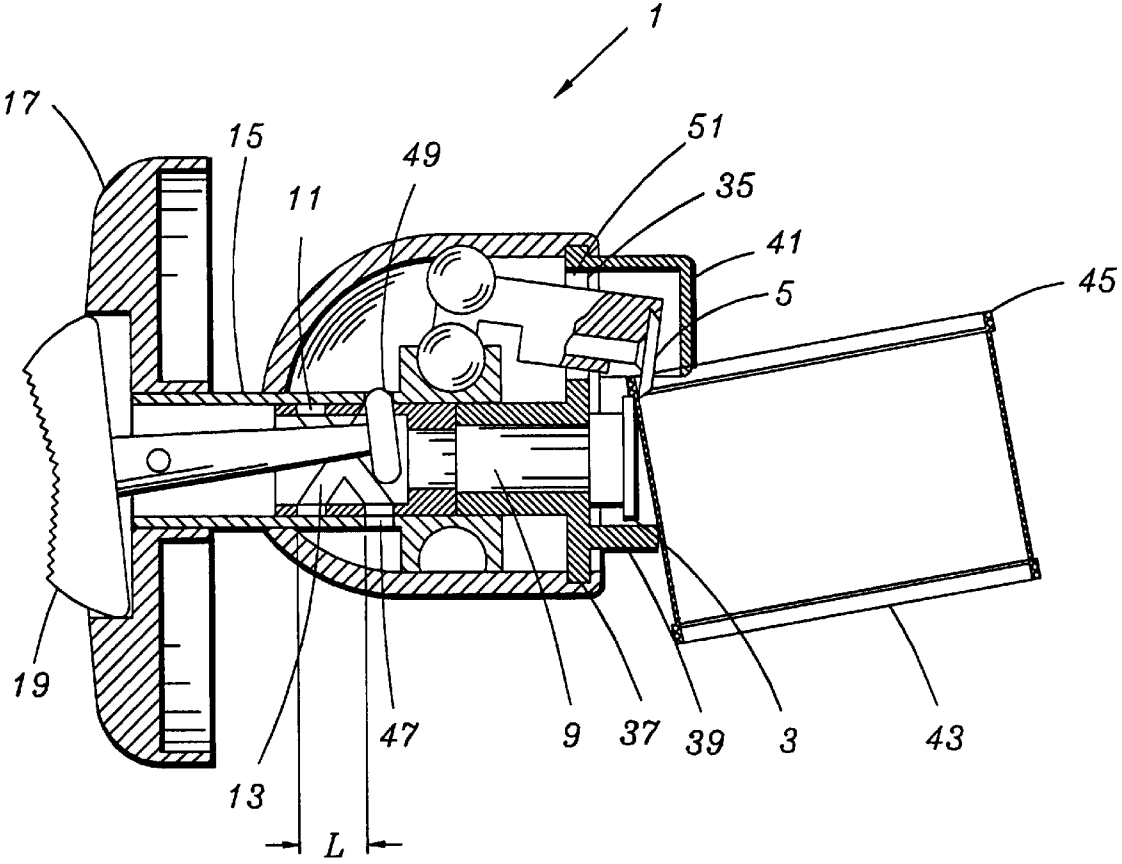
FIG. 3 is a sectional view of the can opener of FIG. 1, shown in an operating position in which a can has been inserted.

As shown in FIG. 3, can guide 39 tilts can 43 into position to be pierced or cut by cutting blade 5 during operation of can opener 1. The mounting plate 37 preferably has a hood 41. The hood 41 is either connected to or, more preferably, integrally formed with the mounting plate. The hood 41 projects downward from above cutting blade 5 to a position above the lowest point of the cutting blade. Upon insertion into can opener 1, the top or end of can 43 contacts hood 41 and is thereby retained in frictional contact with cutting blade 5 during the operation of the can opener. Also), the transport wheel 3 is adapted to engage a rim 45 of a can 43, preferably at the underside of the can rim. The cutting blade 5 is then operated with transport wheel 3 to cut the top from can 43.

The cutting blade 5 is mounted to one end of a substantially "L" shaped blade holder 27. The holder 27 is operatively connected to housing 36. As best shown in FIG. 2, blade holder 27 extends through an aperture 35 of mounting plate 37 beyond the mounting plate.

A pivot 29-1 and sphere 29-2 are arranged to provide blade holder 27 with a radial motion, e.g. towards and away from central axis 7, to engage the top of can 43 to be in the operational position. To this end, pivot 29-1 is positioned at the joint of the two legs of L-shaped blade holder 27. The pivot 29-1 fits into a groove of housing 36 and a groove of blade holder 27. The pivot 29-1 assists in the radial, or up and down, motion of blade holder 27. Sphere 29-2 is friction or tightly fit into a spherical groove 31 formed about the outer circumference of driver 15. The combination of sphere 29-2 and spherical groove 31 of driver 15 form a spherical joint 33. As the drive shaft 9 moves over cam 10, sphere 29-2 slides in groove 31. When driver 15 reaches the end of cam path 13 (or 11) at detent 47 (or 49), drive shaft 9 starts to rotate thereby rotating transport wheel 3. Rotation of transport wheel 3 engages the end of can 43.

The handle 17 and driver 15 has mounted therethrough a switch 19. The handle 17, driver 15 and switch 19 are connected together preferably I)y a pin 21 that passes through all three components,. The switch 19 is operatively connected to driver 15 by pin 21 to place the driver in either a left hand or counter-clockwise mode, or a right hand or clockwise mode. The switch 19 is preferably a toggle switch. The switch 19 is a separate element that is operatively connected to handle 17, again preferably by pin 21.

The switch 19 is connected to an actuating arm 23. The actuating arm 23 is preferably connected at one end to switch 19, and at its other end to an engaging end or pin 25. The actuating arm 23 is also connected to driver 15 by pin 21. The pin 21 is in alignment with a center axis 7 of driver 15. The switch 19 pivots about pin 21 to move actuating arm 23 between a first actuating arm position for use of the left hand mode and a second actuating arm position for use by the right hand mode. As shown in FIG. 1, in the first actuating arm position, engaging pin 25 engages first or left detent 49 of left cam path 11. When actuating arm 23 is in the second actuating arm position, engaging pin 25 engages second or right detent 47 of right cam path 13. The switch 19, actuator arm 23, engaging pin 25 and left and right cam paths 11 and 13, respectfully, together form a directional selector.

Referring to FIGS. 1 through 4, the operation of can opener 1 will be described with reference to the counter-clockwise or left-handed operation of the can opener. However, the steps involved in operation of can opener 1 in the right-handed mode will also be apparent from the following description.

In operation, switch 19 is actuated by rotation around pin 21 to place actuator arm 23 in left cam path 11 to select left-hand operation. The can 43 is positioned so that can rim 45 is engaged by transport wheel 3. Thereafter, handle 17 is rotated through an initial angle that causes rotation of engaging pin 25 within left cam path 11, linearly moves drive shaft 9 outwardly from cam 10 and driver 15, a distance equal to the linear length or stroke L of left cam path 11, e.g. about ⅜ inches, and moves transport wheel 3 toward cutting blade 5 with sufficient force to cause the cutting blade to engage the top of can 43. The movement of mounting plate 37 also brings can 43 into contact with hood 41. The hood 41 provides a downward force or bias on can 43 to maintain frictional contact between can rim 45 and transport wheel 3. The can 43 contacts can opener 1 at an angle due to guide 39.

Upon reaching the terminus of left cam path 11, engaging pin 25 engages first detent 49. Left detent 49, as well as second detent 47, passes through driver 15. The engagement of engaging pin 25 and left detent 49 fixes or interlocks the position of drive shaft 9 relative to driver 15, and transfers any further rotational force that is applied to handle 17 to the driver. Therefore, upon engagement between engaging pin 25 and left detent 49, further counterclockwise rotation of handle 17 rotates transport wheel 3 and driver 15 including spherical groove 31 in a counterclockwise direction.

The sphere 29-2, that forms the terminal end of blade holder 27, is tightly fit in spherical groove 31. Upon rotation of spherical groove 31 in the counterclockwise direction, sphere 29-2 and blade holder 27 will rotate about pivot 29-1 in the counterclockwise direction and the blade holder slides and is in contact with a side wall 51 of aperture 35. This motion causes blade 5 to engage the can top, placing cutting blade 5 in position to cut the top from can 43. As handle 17 is further rotated, the top of can 43 is cut when the can is forced against cutting blade 5 by rotation of transport wheel 3. During cutting, the position of cutting blade 5 is maintained by a constant dragging force exerted on sphere 29-2 by the rotation of spherical groove 31. Upon completion of cutting, cutting blade 5 is disengaged from the can top and can 43 is disengaged from transport wheel 3, by rotating operating handle 17 in a direction opposite the cutting direction.

It should be understood that the foregoing description is only illustrative of the invention. Various alternatives and modifications can be devised by those skilled in the art without departing from the invention. Accordingly, the present invention is intended to encompass all such alternatives, modifications and variances that fall within the scope of the appended claims.

What is claimed is:

1. A can opener for cutting an end of a can, comprising:

a housing;

a driver connected to said housing;

a drive shaft connected to the driver and adapted to slide and rotate in the driver;

a transport wheel connected to the drive shaft to rotate with the drive shaft;

a cutting blade operatively connected to the driver;

a directional selector operatively connected to the driver, the directional selector having a first position in which the driver, drive shaft and transport wheel rotate clockwise to cut the end from the can and a second position in which the driver, drive shaft and transport wheel rotate counterclockwise to cut the end from the can; and means for determining the clockwise and counterclockwise directions of rotation of the driver.

2. The can opener according to claim 1, wherein the driver includes a shaft with an outer surface having a circumferential groove.

3. A can opener for cutting an end of a can, comprising:

a housing;

a driver connected to said housing;

a drive shaft connected to the driver and adapted to slide and rotate in the driver;

a transport wheel connected to the drive shaft to rotate with the drive shaft;

a cutting blade operatively connected to the driver;

a directional selector operatively connected to the driver so that the driver rotates selectively in one of a first direction and a second direction to cut the end from the can, wherein the directional selector has left and right cam driver paths situated on a cam that is connected to the driver; and means for determining the first and second directions of rotation of the driver.

4. The can opener according to claim 3, further comprising a switch having an actuator, and wherein said determining means includes a handle operatively connected to the switch and the driver.

5. The can opener according to claim 4, wherein the switch is adapted to be positioned in one of a first switch position and a second switch position to place the actuator in engagement with the right and left cam paths, wherein the handle is adapted to rotate in the first and second directions to cause the driver to rotate in the first and second directions.

6. The can opener according to claim 5, wherein initial rotation of the handle causes the actuator to travel a selected distance in one of the right and left cam paths.

7. The can opener according to claim 6, wherein the selected distance of travel of the actuator moves the driver a linear distance L to bring the transport wheel into engagement with the cam and the blade into engagement with the end of the can.

8. The can opener according to claim 3, wherein the directional selector includes a lock for interlocking the actuator and the driver to enable the driver to rotate in the one of the first and second directions that corresponds to the selected one of the right and left cam paths.

9. A can opener for cutting an end of a can, comprising:

a housing;

a driver connected to said housing, said driver including a shaft with an outer groove;

a drive shaft connected to the driver and adapted to slide and rotate in the driver;

a transport wheel connected to the drive shaft to rotate with the drive shaft;

a cutting blade operatively connected to the driver;

a directional selector operatively connected to the driver so that the driver rotates selectively in one of a first direction and a second direction to cut the end from the can;

means for determining the first and second directions of rotation of the driver; and a blade holder for holding the cutting blade, wherein the blade holder has a spherical end that is adapted to be fitted into the outer groove such that the outer groove and the spherical end, in combination, form a spherical joint.

10. The can opener according to claim 9, wherein the spherical end is tightly fit in the groove such that the spherical end will rotate in the groove upon rotation of the driver, and thus the spherical joint, in one of the first and second directions until further rotation of the spherical end is prevented in that direction.

11. The can opener according to claim 10, wherein the groove exerts a drag force on the spherical end upon prevention of further rotation of the spherical joint, wherein the drag force is transmitted through the blade holder to the cutting blade.

12. The can opener according to claim 11, further comprising means for limiting radial movement of the blade holder in the operating direction, wherein the spherical end is radially displaced with the groove until the blade holder contacts the limiting means, and wherein further rotation of the blade holder by the groove is prevented by contact between the blade holder and the limiting means.

13. The can opener according to claim 12, wherein the drag force maintains the cutting blade in position against the limiting means during the cutting of the end of the can.

14. The can opener according to claim 13, wherein the limiting means is a plate extending in a direction perpendicular to the operating direction, and wherein the plate has an aperture through which the blade holder extends.

15. The can opener according to claim 14, wherein the aperture functions as the limiting means for limiting radial movement of the blades holder.

16. The can opener according to claim 15, wherein the plate has an extension that projects from above the cutting blade downward toward the transport wheel and terminating at a point above the lowest point of the cutting blade, the extension providing a force against the can inserted into the can opener to maintain the can in frictional contact with the transport wheel during cutting.

17. The can opener according to claim 16, further comprising means for tilting the can engaged by the transport wheel towards the cutting blade.

18. The can opener according to claim 17, wherein the tilting means includes a shelf extending outward from the plate below the transport wheel.

19. The can opener according to claim 9, wherein the directional selector includes a cam having a pair of helical cam paths.

20. The can opener according to claim 19, wherein one of the pair of helical (am paths causes the driver to rotate in the first direction and the other of the pair of cam paths causes driver to rotate in the second direction.

* * * * *